US010218052B2

(12) United States Patent
Pascolini et al.

(10) Patent No.: US 10,218,052 B2
(45) Date of Patent: Feb. 26, 2019

(54) ELECTRONIC DEVICE WITH TUNABLE HYBRID ANTENNAS

(71) Applicant: Apple Inc., Cupertino, CA (US)

(72) Inventors: Mattia Pascolini, San Francisco, CA (US); Umar Azad, San Jose, CA (US); Rodney A. Gomez Angulo, Sunnyvale, CA (US); Erdinc Irci, Santa Clara, CA (US); Qingxiang Li, Mountain View, CA (US); Matthew A. Mow, Los Altos, CA (US); Harish Rajagopalan, San Jose, CA (US); Miroslav Samardzija, Mountain View, CA (US); Ming-Ju Tsai, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 249 days.

(21) Appl. No.: 14/710,377

(22) Filed: May 12, 2015

(65) Prior Publication Data

US 2016/0336643 A1 Nov. 17, 2016

(51) Int. Cl.
*H01Q 1/24* (2006.01)
*H01Q 9/04* (2006.01)
(Continued)

(52) U.S. Cl.
CPC ..... *H01Q 1/243* (2013.01); *H01Q 5/328* (2015.01); *H01Q 9/0421* (2013.01);
(Continued)

(58) Field of Classification Search
CPC ..... H01Q 1/12; H01Q 1/1264; H01Q 1/38; H01Q 11/04; H01Q 21/00; H01Q 21/0087; Y10T 29/49018
(Continued)

(56) References Cited

U.S. PATENT DOCUMENTS 4,016,490 A 4/1977 Weckenmann et al.
4,360,813 A * 11/1982 Fitzsimmons ..... H01Q 21/064 342/350
(Continued)

FOREIGN PATENT DOCUMENTS

CN 1343380 4/2002
CN 1543010 11/2004
(Continued)

OTHER PUBLICATIONS

Zhu et al., U.S. Appl. No. 14/180,866, filed Feb. 14, 2014.
(Continued)

*Primary Examiner* — Dieu Hien T Duong
*Assistant Examiner* — Bamidele A Jegede
(74) *Attorney, Agent, or Firm* — Treyz Law Group, P.C.; G. Victor Treyz; Tianyi He

(57) ABSTRACT

An electronic device may have hybrid antennas that include slot antenna resonating elements formed from slots in a ground plane and planar inverted-F antenna resonating elements. The planar inverted-F antenna resonating elements may each have a planar metal member that overlaps one of the slots. The slot of each slot antenna resonating element may divide the ground plane into first and second portions. A return path and feed may be coupled in parallel between the planar metal member and the first portion of the ground plane. Tunable components such as tunable inductors may be used to tune the hybrid antennas. A tunable inductor may bridge the slot in hybrid antenna, may be coupled between the planar metal member of the planar inverted-F antenna resonating element and the ground plane, or multiple tunable inductors may bridge the slot on opposing sides of the planar inverted-F antenna resonating element.

20 Claims, 11 Drawing Sheets

(51) Int. Cl.
*H01Q 13/10* (2006.01)
*H01Q 21/30* (2006.01)
*H01Q 5/328* (2015.01)

(52) U.S. Cl.
CPC ..... *H01Q 9/0442* (2013.01); *H01Q 13/103* (2013.01); *H01Q 21/30* (2013.01)

(58) Field of Classification Search
USPC ..... 343/772
See application file for complete search history.

(56) References Cited

U.S. PATENT DOCUMENTS 4,614,937 A 9/1986 Poujois
5,337,353 A 8/1994 Boie et al.
5,410,497 A 4/1995 Viletto
5,463,406 A 10/1995 Vannatta et al.
5,650,597 A 7/1997 Redmayne
5,826,458 A 10/1998 Little
5,854,972 A 12/1998 Pennock et al.
5,864,316 A 1/1999 Bradley et al.
5,905,467 A 5/1999 Narayanaswamy et al.
5,956,626 A 9/1999 Kashke et al.
6,181,281 B1 1/2001 Desclos
6,301,489 B1 10/2001 Winstead et al.
6,329,958 B1 12/2001 McLean et al.
6,380,899 B1 4/2002 Madsen et al.
6,408,193 B1 6/2002 Katagishi et al.
6,445,906 B1 9/2002 Nguyen et al.
6,456,856 B1 9/2002 Werling et al.
6,480,162 B2 11/2002 Sabet
6,529,088 B2 3/2003 Lafleur et al.
6,590,539 B2 7/2003 Shinichi
6,611,227 B1 8/2003 Nebiyeloul-Kifle et al.
6,657,595 B1 12/2003 Phillips et al.
6,678,532 B1 1/2004 Mizoguchi
6,741,214 B1 5/2004 Kadambi et al.
6,788,266 B2 9/2004 St. Hillaire
6,879,293 B2 4/2005 Sato
6,975,276 B2 12/2005 Brown
6,978,121 B1 12/2005 Lane et al.
6,985,108 B2 1/2006 Mikkola
6,985,113 B2 1/2006 Nishimura et al.
7,016,686 B2 3/2006 Spaling
7,039,435 B2 5/2006 McDowell et al.
7,050,010 B2 5/2006 Wang et al.
7,109,945 B2 9/2006 Mori
7,113,087 B1 9/2006 Casebolt
7,146,139 B2 12/2006 Nevermann
7,221,092 B2 5/2007 Anzai et al.
7,356,361 B1 4/2008 Hawkins et al.
7,388,550 B2 6/2008 McLean
7,499,722 B2 3/2009 McDowell et al.
7,502,221 B2 3/2009 Fuller et al.
7,522,846 B1 4/2009 Lewis et al.
7,538,760 B2 5/2009 Hotelling et al.
7,551,142 B1 6/2009 Zhang et al.
7,557,760 B2 7/2009 Chang et al.
7,595,788 B2 9/2009 Son
7,633,076 B2 12/2009 Huppi et al.
7,663,612 B2 2/2010 Bladt
7,705,787 B2 4/2010 Ponce De Leon
7,826,875 B2 11/2010 Karaoguz et al.
7,834,813 B2 11/2010 Caimi et al.
7,864,123 B2 1/2011 Hill et al.
7,876,274 B2 1/2011 Hobson et al.
7,999,748 B2 8/2011 Lightenberg et al.
8,059,039 B2 11/2011 Vazquez et al.
8,059,040 B2 11/2011 Vazquez et al.
8,115,753 B2 2/2012 Newton
8,159,399 B2 4/2012 Dorsey et al.
8,228,198 B2 7/2012 McAllister
8,238,971 B2 8/2012 Terlizzi
8,255,009 B2 8/2012 Sorensen et al.
8,270,914 B2 9/2012 Pascolini et al.
8,319,692 B2 11/2012 Chiang et al.
8,325,094 B2 12/2012 Vazquez et al.
8,326,221 B2 12/2012 Dorsey et al.
8,347,014 B2 1/2013 Schubert et al.
8,368,602 B2 2/2013 Hill
8,417,296 B2 4/2013 Cabellero et al.
8,432,322 B2 4/2013 Amm et al.
8,436,816 B2 5/2013 Leung et al.
8,466,839 B2 6/2013 Schlub et al.
8,497,806 B2 7/2013 Lai
8,517,383 B2 8/2013 Wallace et al.
8,525,734 B2 9/2013 Krogerus
8,531,337 B2 9/2013 Castany et al.
8,577,289 B2 11/2013 Schlub et al.
8,610,629 B2 12/2013 Pascolini et al.
8,638,266 B2 1/2014 Liu
8,638,549 B2 1/2014 Garelli et al.
8,648,752 B2 2/2014 Ramachandran et al.
8,749,523 B2 6/2014 Pance et al.
8,781,420 B2 7/2014 Schlub et al.
8,798,554 B2 8/2014 Darnell et al.
8,836,587 B2 9/2014 Darnell et al.
8,872,706 B2 10/2014 Caballero et al.
8,896,488 B2 11/2014 Vazquez et al.
8,947,302 B2 2/2015 Caballero et al.
8,947,305 B2 2/2015 Amm et al.
8,952,860 B2 2/2015 Li et al.
8,963,782 B2 2/2015 Vazquez et al.
8,963,784 B2 2/2015 Zhu et al.
9,024,823 B2 5/2015 Bevelacqua
9,093,752 B2 7/2015 Yarga et al.
9,153,874 B2 10/2015 Ouyang et al.
9,257,750 B2 2/2016 Vazquez et al.
9,276,319 B2 3/2016 Vazquez et al.
9,293,828 B2 3/2016 Bevelacqua et al.
9,300,342 B2 3/2016 Schlub et al.
9,331,397 B2 5/2016 Jin et al.
9,337,537 B2 5/2016 Hu et al.
2002/0015024 A1 2/2002 Westerman et al.
2002/0027474 A1 3/2002 Bonds
2002/0060645 A1 5/2002 Shinichi
2002/0094789 A1 7/2002 Harano
2002/0123309 A1 9/2002 Collier et al.
2002/0135521 A1 9/2002 Moore
2003/0062907 A1 4/2003 Nevermann
2003/0186728 A1 10/2003 Manjo
2003/0193437 A1* 10/2003 Kangasvieri ..... H01Q 1/243 343/702
2003/0193438 A1 10/2003 Yoon
2003/0197597 A1 10/2003 Bahl et al.
2003/0210203 A1 11/2003 Phillips et al.
2003/0218993 A1 11/2003 Moon et al.
2004/0051670 A1 3/2004 Sato
2004/0080457 A1 4/2004 Guo
2004/0104853 A1 6/2004 Chen
2004/0176083 A1 9/2004 Shiao et al.
2004/0189542 A1 9/2004 Mori
2004/0222926 A1 11/2004 Kontogeorgakis et al.
2004/0239575 A1 12/2004 Shoji
2005/0146475 A1 7/2005 Bettner
2005/0168384 A1 8/2005 Wang et al.
2005/0245204 A1 11/2005 Vance
2005/0264466 A1 12/2005 Hibino et al.
2006/0001576 A1 1/2006 Contopanagos
2006/0152497 A1 7/2006 Rekimoto
2006/0161871 A1 7/2006 Hotelling et al.
2006/0232468 A1 10/2006 Parker et al.
2006/0244663 A1 11/2006 Fleck et al.
2006/0248363 A1 11/2006 Chen et al.
2006/0274493 A1 12/2006 Richardson et al.
2006/0278444 A1 12/2006 Binstead
2007/0120740 A1 5/2007 Iellici
2007/0126711 A1 6/2007 Oshita
2007/0188375 A1 8/2007 Richards et al.
2007/0239921 A1 10/2007 Toorains et al.
2008/0165063 A1 7/2008 Schlub et al.
2008/0246735 A1 10/2008 Reynolds et al.
2008/0248837 A1 10/2008 Kunkel
2008/0297487 A1 12/2008 Hotelling et al.

(56) References Cited

U.S. PATENT DOCUMENTS

2008/0309836 A1 12/2008 Sakama et al.
2008/0316117 A1* 12/2008 Hill ..... H01Q 1/243 343/702
2008/0316120 A1 12/2008 Hirota et al.
2009/0000023 A1 1/2009 Wegelin et al.
2009/0058735 A1 3/2009 Hill et al.
2009/0096683 A1 4/2009 Rosenblatt et al.
2009/0128435 A1 5/2009 Jeng
2009/0153407 A1* 6/2009 Zhang ..... H01Q 1/243 343/702
2009/0153410 A1 6/2009 Chiang
2009/0153422 A1* 6/2009 Chiang ..... H01Q 1/2266 343/749
2009/0174611 A1 7/2009 Schlub et al.
2009/0256757 A1* 10/2009 Chiang ..... H01Q 13/10 343/702
2009/0256758 A1 10/2009 Schlub et al.
2009/0295648 A1 12/2009 Dorsey et al.
2010/0062728 A1 3/2010 Black et al.
2010/0079351 A1 4/2010 Huang
2010/0081374 A1 4/2010 Moosavi
2010/0109971 A2 5/2010 Gummalla et al.
2010/0167672 A1 7/2010 Ahn et al.
2010/0182203 A1 7/2010 See
2010/0238072 A1 9/2010 Ayatollahi et al.
2010/0253651 A1 10/2010 Day
2011/0012793 A1 1/2011 Amm et al.
2011/0012794 A1 1/2011 Schlub et al.
2011/0045789 A1 2/2011 Sinton et al.
2011/0050509 A1 3/2011 Vazquez et al.
2011/0212746 A1 9/2011 Sarkar et al.
2011/0241949 A1 10/2011 Nickel et al.
2011/0260924 A1 10/2011 Roy
2011/0260939 A1 10/2011 Korva et al.
2011/0300907 A1 12/2011 Hill et al.
2012/0009983 A1* 1/2012 Mow ..... H01Q 1/243 455/575.7
2012/0068893 A1 3/2012 Guterman et al.
2012/0092298 A1 4/2012 Koottungal
2012/0112969 A1 5/2012 Caballero et al.
2012/0112970 A1 5/2012 Caballero et al.
2012/0176279 A1 7/2012 Merz et al.
2012/0214412 A1 8/2012 Schlub et al.
2012/0223865 A1 9/2012 Li et al.
2012/0223866 A1 9/2012 Vazquez et al.
2012/0229360 A1 9/2012 Jagielski et al.
2012/0299785 A1 11/2012 Bevelacqua
2013/0050038 A1 2/2013 Eom et al.
2013/0082884 A1 4/2013 Gummalla
2013/0106660 A1 5/2013 Kang
2013/0115884 A1 5/2013 Zhang
2013/0154900 A1 6/2013 Tsai et al.
2013/0169490 A1 7/2013 Pascolini et al.
2013/0201067 A1 8/2013 Hu et al.
2013/0203364 A1 8/2013 Darnell et al.
2013/0234910 A1 9/2013 Oh et al.
2013/0241800 A1 9/2013 Schlub et al.
2013/0257659 A1 10/2013 Darnell et al.
2013/0285857 A1 10/2013 Schlutz
2013/0293425 A1 11/2013 Zhu et al.
2013/0321216 A1 12/2013 Jervis et al.
2013/0328730 A1 12/2013 Guterman et al.
2013/0333496 A1 12/2013 Boutouil et al.
2013/0342411 A1 12/2013 Jung
2014/0009352 A1 1/2014 Sung
2014/0086441 A1 3/2014 Zhu
2014/0184450 A1 7/2014 Koo
2014/0253392 A1 9/2014 Yarga et al.
2014/0266922 A1 9/2014 Jin et al.
2014/0266923 A1 9/2014 Zhou et al.
2014/0266938 A1 9/2014 Ouyang et al.
2014/0266941 A1 9/2014 Vazquez et al.
2014/0292587 A1 10/2014 Yarga et al.
2014/0292598 A1 10/2014 Bevelacqua et al.
2014/0306857 A1 10/2014 Bevelacqua
2014/0313087 A1 10/2014 Jiang et al.
2014/0315592 A1 10/2014 Schlub et al.
2014/0328488 A1 11/2014 Caballero et al.
2014/0333495 A1 11/2014 Vazquez et al.
2014/0333496 A1 11/2014 Hu et al.
2014/0340265 A1 11/2014 Vazquez et al.
2014/0375509 A1 12/2014 Vance et al.
2015/0180123 A1 6/2015 Tatomirescu
2015/0236426 A1* 8/2015 Zhu ..... H01Q 13/10 343/702
2015/0255851 A1 9/2015 Guterman et al.
2015/0257158 A1 9/2015 Jadhav et al.
2015/0270618 A1 9/2015 Zhu et al.
2015/0270619 A1 9/2015 Zhu et al.
2015/0311594 A1 10/2015 Zhu et al.

FOREIGN PATENT DOCUMENTS

CN 101330162 12/2008
CN 101627537 A 1/2010
CN 101682119 A 3/2010
CN 202978926 U 6/2013
CN 103811871 A 5/2014
CN 104064877 A 9/2014
CN 104143691 A 11/2014
CN 104241873 A 12/2014
DE 102005035935 2/2007
EP 0086135 8/1983
EP 0 564 164 10/1993
EP 1298809 4/2003
EP 1324425 7/2003
EP 1361623 11/2003
EP 1 469 550 10/2004
EP 1 524 774 4/2005
EP 1564896 8/2005
EP 1593988 11/2005
GB 2 380 359 4/2003
JP 05-128828 5/1993
JP 2003179670 6/2003
JP 2003209483 7/2003
JP 2003330618 11/2003
JP 2004005516 1/2004
JP 200667061 3/2006
JP 2007-170995 7/2007
JP 2008046070 2/2008
JP 2009032570 2/2009
WO 0131733 5/2001
WO 02/05443 1/2002
WO 2004112187 12/2004
WO 2005112280 11/2005
WO 2007116790 4/2006
WO 2006060232 6/2006
WO 2007124333 1/2007
WO 2008/078142 7/2008
WO 2009022387 2/2009
WO 2009149023 12/2009
WO 2011022067 2/2011
WO 2004010528 8/2013
WO 2013123109 A1 8/2013
WO 2013165419 11/2013
WO 20310165419 11/2013
WO 2015142476 9/2015

OTHER PUBLICATIONS

Guterman et al., U.S. Appl. No. 14/202,860, filed Mar. 10, 2014.
Myllmaki et al., "Capacitive recognition of the user's hand grip position in mobile handsets", Progress in Electromagnetics Research B, vol. 22, 2010, pp. 203-220.
"CapTouch Programmable Controller for Single-Electrode Capacitance Sensors", AD7147 Data Sheet Rev. B, [online], Analog Devices, Inc., [retrieved on Dec. 7, 2009], <URL: http://www.analog.com/static/imported-files/data_sheets/AD7147.pdf>.
Liu et al., MEMS-Switched, Frequency-Tunable Hybrid Slot/PIFA Antenna; IEEE Antennas and Wireless Propagation Letters, vol. 8, 2009; p. 311-314.

(56) References Cited

OTHER PUBLICATIONS

The ARRL Antenna Book, Published by the American Radio League, 1998, 15th Edition, ISBN: 1-87259-206-5.
Pance et al., U.S. Appl. No. 61/235,905, filed Aug. 21, 2009.
Azad et al., U.S. Appl. No. 15/066,419, filed Mar. 10, 2016.

* cited by examiner

ELECTRONIC DEVICE WITH TUNABLE HYBRID ANTENNAS

BACKGROUND

This relates to electronic devices, and more particularly, to antennas for electronic devices with wireless communications circuitry.

Electronic devices such as portable computers and cellular telephones are often provided with wireless communications capabilities. To satisfy consumer demand for small form factor wireless devices, manufacturers are continually striving to implement wireless communications circuitry such as antenna components using compact structures. At the same time, there is a desire for wireless devices to cover a growing number of communications bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device may have a metal housing that forms a ground plane. The ground plane may, for example, be formed from a rear housing wall and sidewalls. The ground plane and other structures in the electronic device may be used in forming antennas.

The electronic device may include one or more hybrid antennas. The hybrid antennas may each include a slot antenna resonating element formed from a slot in the ground plane and a planar inverted-F antenna resonating element. The planar inverted-F antenna resonating element may serve as indirect feed structure for the slot antenna resonating element.

A planar inverted-F antenna resonating element may have a planar metal member that overlaps one of the slot antenna resonating elements. The slot of the slot antenna resonating element may divide the ground plane into first and second portions. A return path and feed may be coupled in parallel between the planar metal member and the first portion of the ground plane.

Tunable components such as tunable inductors may be used to tune the hybrid antennas. A tunable inductor may bridge the slot in a hybrid antenna, may be coupled between the planar metal member of the planar inverted-F antenna resonating element and the ground plane, or multiple tunable inductors may bridge the slot on opposing sides of the planar inverted-F antenna resonating element.

DETAILED DESCRIPTION

Figure 1:
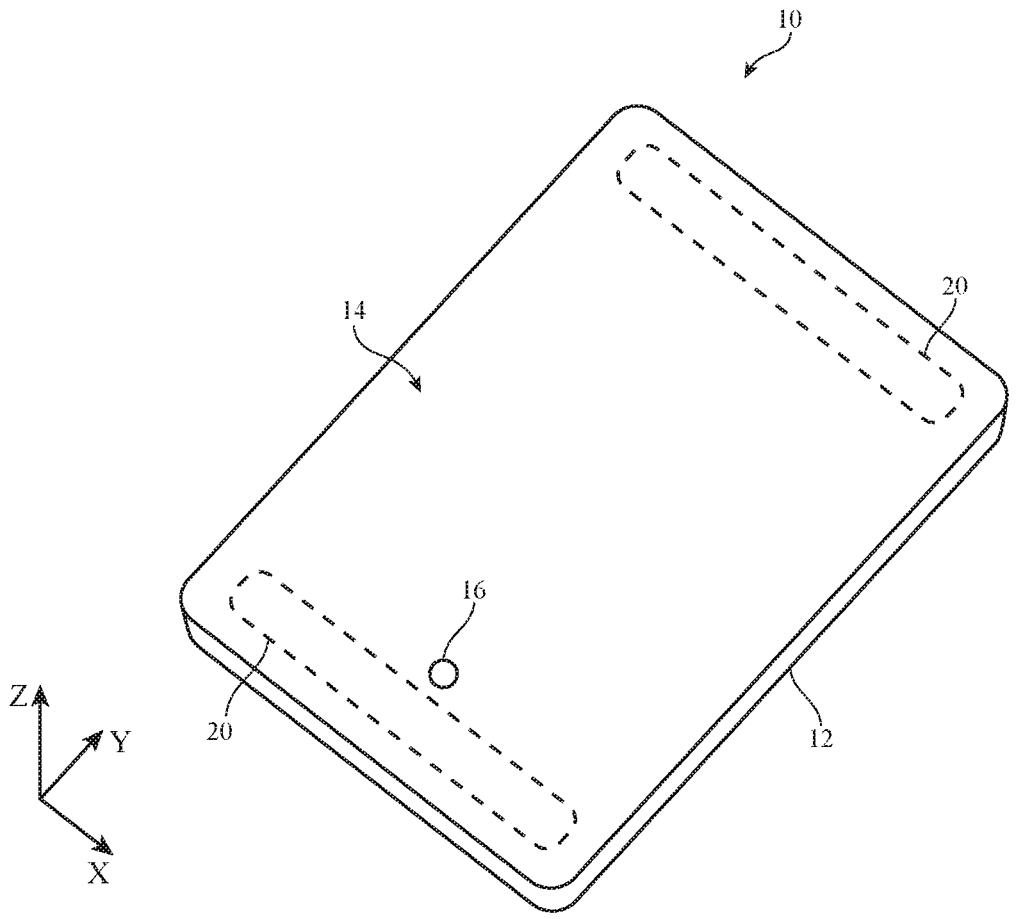
FIG. 1 is a front perspective view of an illustrative electronic device in accordance with an embodiment.

An electronic device such as electronic device 10 of FIG. 1 may be provided with wireless circuitry that includes antenna structures. The antenna structures may include hybrid antennas. The hybrid antennas may be hybrid planar-inverted-F-slot antennas that include slot antenna resonating elements and planar inverted-F antenna resonating elements. The planar inverted-F antenna resonating elements may indirectly feed the slot antenna resonating elements and may contribute to the frequency responses of the antennas. Slots for the slot antenna resonating elements may be formed in ground structures such as conductive housing structures.

The wireless circuitry of device 10 may handles one or more communications bands. For example, the wireless circuitry of device 10 may include a Global Position System (GPS) receiver that handles GPS satellite navigation system signals at 1575 MHz or a GLONASS receiver that handles GLONASS signals at 1609 MHz. Device 10 may also contain wireless communications circuitry that operates in communications bands such as cellular telephone bands and wireless circuitry that operates in communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications at 13.56 MHz or other near-field communications frequencies. If desired, device 10 may include wireless communications circuitry for communicating at 60 GHz, circuitry for supporting light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

In the example of FIG. 1, device 10 includes a display such as display 14. Display 14 has been mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass or clear plastic. Openings may be formed in the display cover layer. For example, an opening may be formed in the display cover layer to accommodate a button such as button 16. An opening may also be formed in the display cover layer to accommodate ports such as a speaker port. Openings may be formed in housing 12 to form communications ports (e.g., an audio jack port, a digital data port, etc.). Openings in housing 12 may also be formed for audio components such as a speaker and/or a microphone.

Antennas may be mounted in housing 12. For example, housing 12 may have four peripheral edges as shown in FIG. 1 and one or more antennas may be located along one or more of these edges. As shown in the illustrative configuration of FIG. 1, antennas may, if desired, be mounted in regions 20 along opposing peripheral edges of housing 12 (as an example). The antennas may include slots in the rear of housing 12 in regions such as regions 20 and may emit and receive signals through the front of device 10 (i.e., through inactive portions of display 14) and/or through the rear of device 10. Antennas may also be mounted in other portions of device 10, if desired. The configuration of FIG. 1 is merely illustrative.

Figure 2:
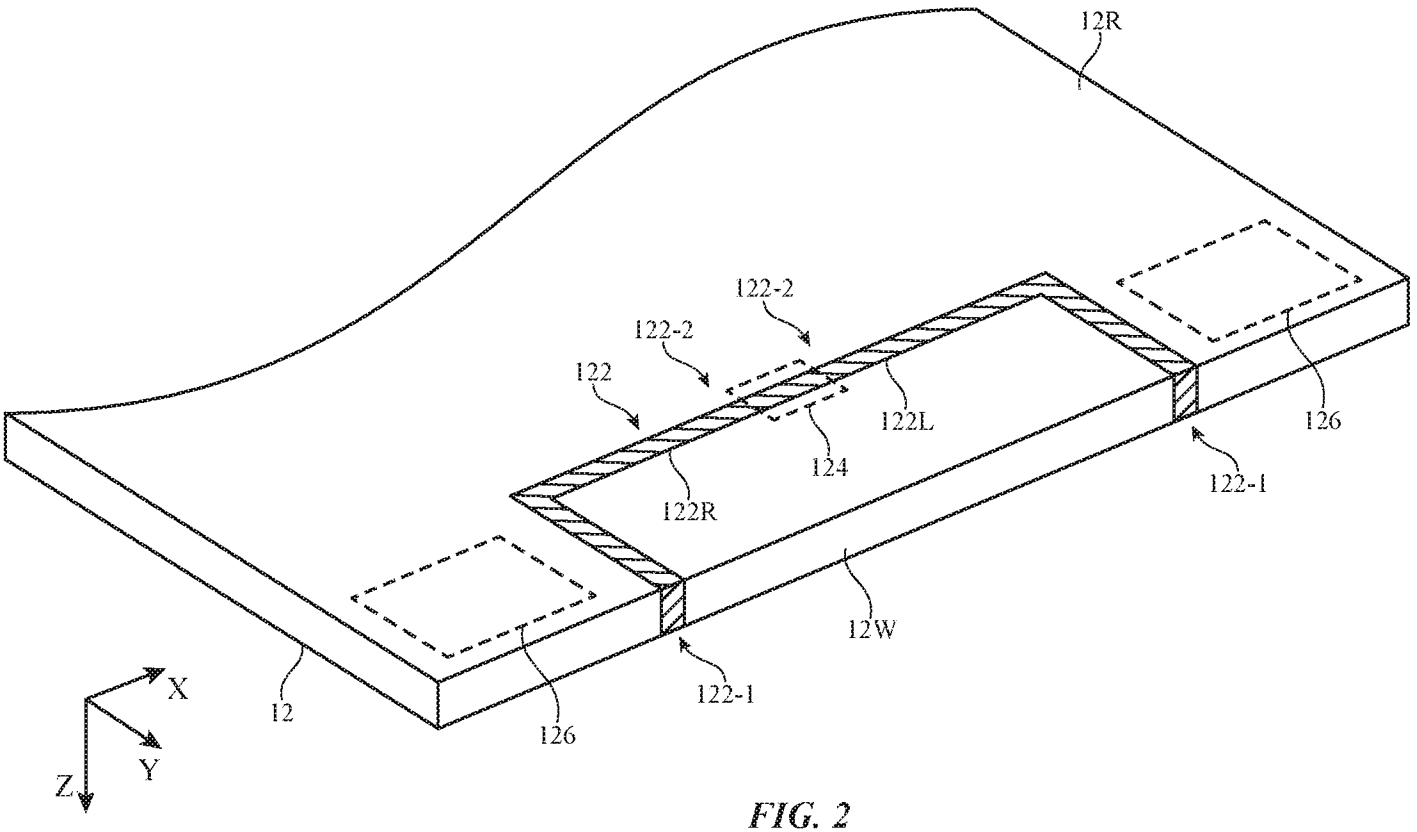
FIG. 2 is a rear perspective view of a portion of the illustrative electronic device of FIG. 1 in accordance with an embodiment.

FIG. 2 is a rear perspective view of the upper end of housing 12 and device 10 of FIG. 1. As shown in FIG. 2, one or more slots such as slot 122 may be formed in housing 12. Housing 12 may be formed from a conductive material such as metal. Slot 122 may be an elongated opening in the metal of housing 12 and may be filled with a dielectric material such as glass, ceramic, plastic, or other insulator. The width of slot 122 may be 0.1-1 mm, less than 1.3 mm, less than 1.1 mm, less than 0.9 mm, less than 0.7 mm, less than 0.5 mm, less than 0.3 mm, more than 0.2 mm, more than 0.5 mm, more than 0.1 mm, 0.2-0.9 mm, 0.2-0.7 mm, 0.3-0.7 mm, or other suitable width. The length of slot 122 may be more than 4 cm, more than 6 cm, more than 10 cm, 5-20 cm, 4-15 cm, less than 15 cm, less than 25 cm, or other suitable length.

Slot 122 may extend across rear housing wall 12R and, if desired, an associated sidewall such as sidewall 12W. Rear housing wall 12R may be planar or may be curved. Sidewall 12W may be an integral portion of rear wall 12R or may be a separate structure. Housing wall 12R (and, if desired, sidewalls such as sidewall 12W) may be formed from aluminum, stainless steel, or other metals and may form a ground plane for device 10. Slots in the ground plane such as slot 122 may be used in forming antenna resonating elements.

In the example of FIG. 2, slot 122 has a U-shaped footprint (i.e., the outline of slot 122 has a U shape when viewed along dimension Z). Other shapes for slot 122 may be used, if desired (e.g., straight shapes, shapes with curves, shapes with curved and straight segments, etc.). With a layout of the type shown in FIG. 2, the bends in slot 122 create space along the left and right edges of housing 12 for components 126. Components 126 may be, for example, speakers, microphones, cameras, sensors, or other electrical components.

Slot 122 may be divided into two shorter slots using a conductive structure such as conductive member 124. Conductive member 124 may be formed from metal traces on a printed circuit, metal foil, metal portions of a housing bracket, wire, a sheet metal structure, or other conductive structure in device 10. Conductive member 124 may be shorted to metal housing wall 12R on opposing sides of slot 122.

In the presence of conductive member 124, slot 122 may be divided into first and second slots 122L and 122R. Ends 122-1 of slots 122L and 122R are surrounded by air and dielectric structures such as glass or other dielectric associated with a display cover layer for display 14 and are therefore sometimes referred to as open slot ends. Ends 122-2 of slots 122L and 122R are terminated in conductive structure 124 and therefore are sometimes referred to as closed slot ends. In the example of FIG. 2, slot 122L is an open slot having an open end 122-1 and an opposing closed end 122-2. Slot 122R is likewise an open slot. If desired, device 10 may include closed slots (e.g., slots in which both ends are terminated with conductive structures). The configuration of FIG. 2 is merely illustrative.

Slot 122 may be fed using an indirect feeding arrangement. With indirect feeding, a structure such as a planar-inverted-F antenna resonating element may be near-field coupled to slot 122 and may serve as an indirect feed structure. The planar inverted-F antenna resonating element may also exhibit resonances that contribute to the frequency response of the antenna formed from slot 122 (i.e., the antenna may be a hybrid planar-inverted-F-slot antenna).

Figure 3:
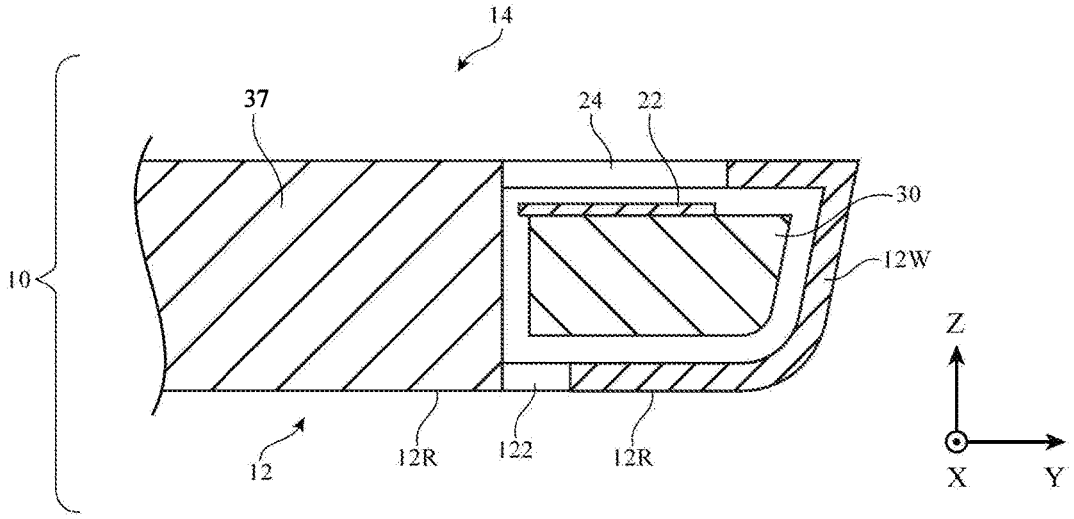
FIG. 3 is a cross-sectional side view of a portion of an illustrative electronic device in accordance with an embodiment.

A cross-sectional side view of device 10 in the vicinity of slot 122 is shown in FIG. 3. In the example of FIG. 3, conductive structures 37 may include display 14, conductive housing structures such as metal rear housing wall 12R, etc. Dielectric layer 24 may be a portion of a glass layer (e.g., a portion of a display cover layer for protecting display 14). The underside of layer 24 may, if desired, be covered with an opaque masking layer to block internal components in device 10 from view. Dielectric support 30 may be used to support conductive structures such as metal structure 22. Metal structure 22 may be located under dielectric layer 24 and may, if desired, be used in forming an antenna feed structure (e.g., structure 22 may be a planar metal member that forms part of a planar inverted-F antenna resonating element structure that is near-field coupled to slot 122 in housing 12). During operation, antenna signals associated with an antenna formed from slot 122 and/or metal structure 22 may be transmitted and received through the front of device 10 (e.g., through dielectric layer 24) and/or the rear of device 10.

Figure 4:
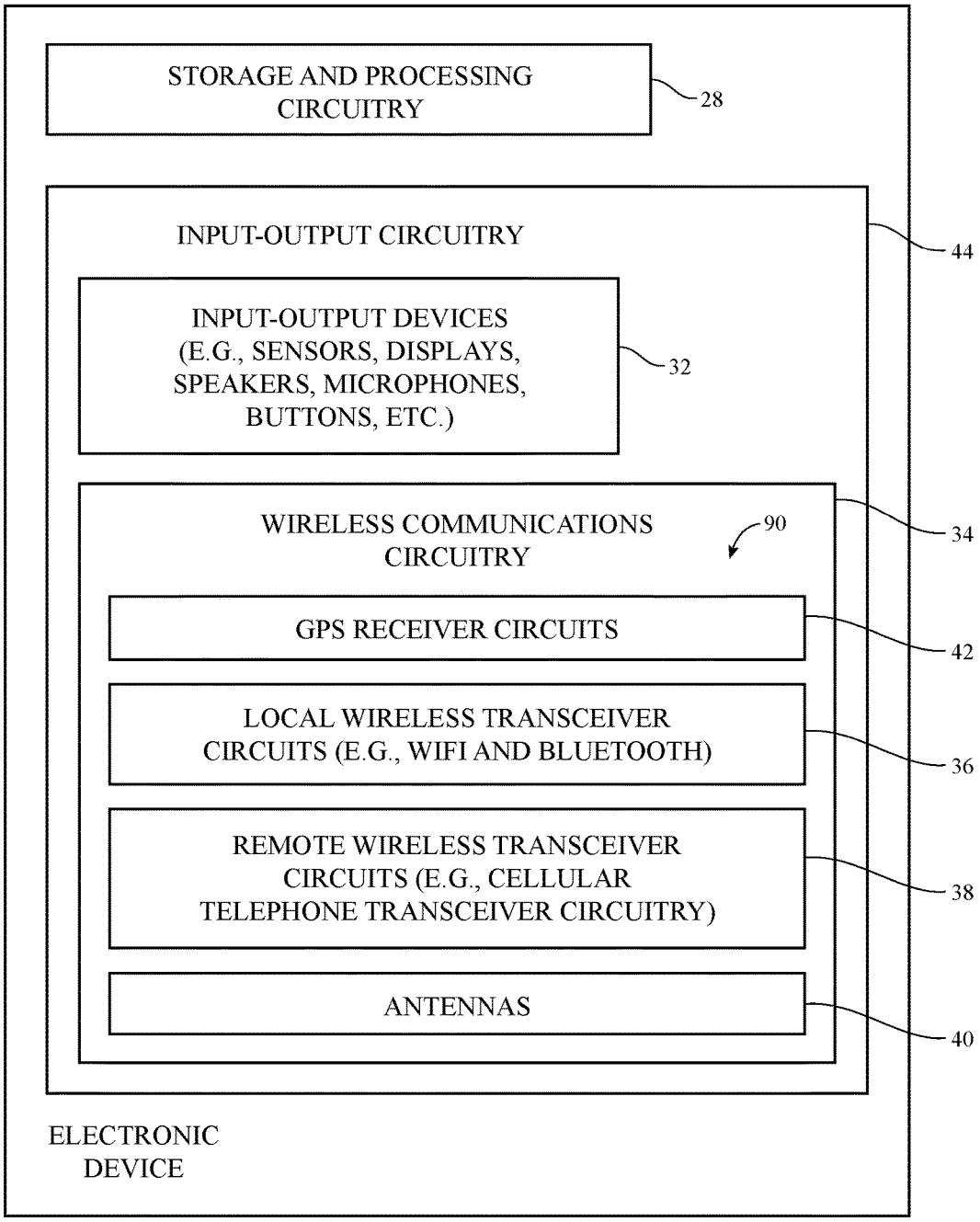
FIG. 4 is a schematic diagram of illustrative circuitry in an electronic device in accordance with an embodiment.

A schematic diagram showing illustrative components that may be used in device 10 is shown in FIG. 4. As shown in FIG. 4, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1500 to 2170 MHz (e.g., a midband with a peak at 1700 MHz), and a high band from 2170 or 2300 to 2700 MHz (e.g., a high band with a peak at 2400 MHz) or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include satellite navigation system circuitry such as global positioning system (GPS) receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 5:
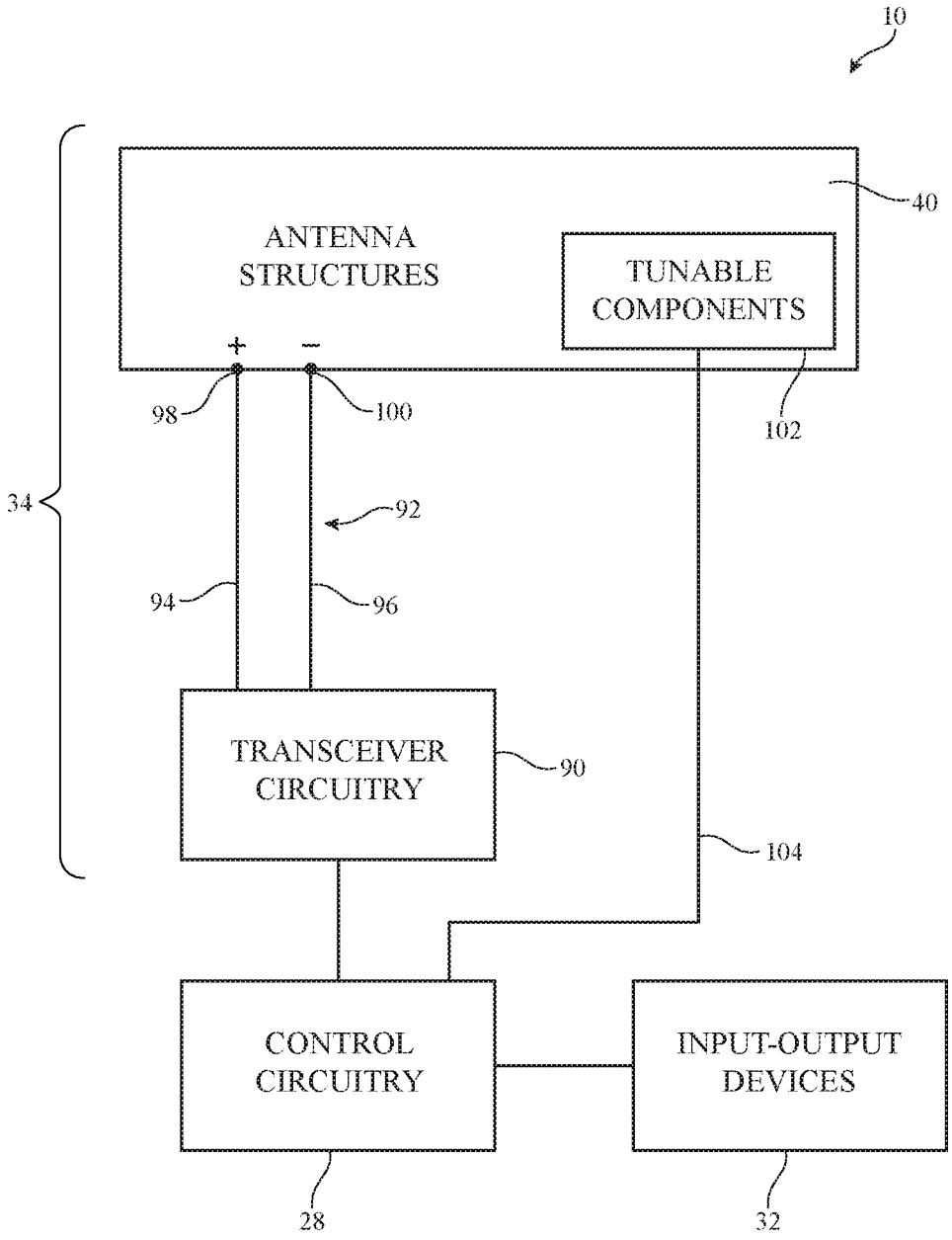
FIG. 5 is a diagram of illustrative wireless circuitry in an electronic device in accordance with an embodiment.

As shown in FIG. 5, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures.

During operation of device 10, control circuitry 28 may issue control signals on one or more paths such as path 104 that adjust inductance values, capacitance values, or other parameters associated with tunable components 102, thereby tuning antenna structures 40 to cover desired communications bands.

Path 92 may include one or more transmission lines. As an example, signal path 92 of FIG. 5 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 92 may be directly coupled to an antenna resonating element and ground for antenna 40 or may be coupled to near-field-coupled antenna feed structures that are used in indirectly feeding a resonating element for antenna 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Antenna structures 40 may include an antenna resonating element such as a slot antenna resonating element or other element that is indirectly fed using near-field coupling. In a near-field coupling arrangement, transmission line 92 is coupled to a near-field-coupled antenna feed structure that is used to indirectly feed antenna structures such as an antenna slot or other element through near-field electromagnetic coupling.

Figure 6:
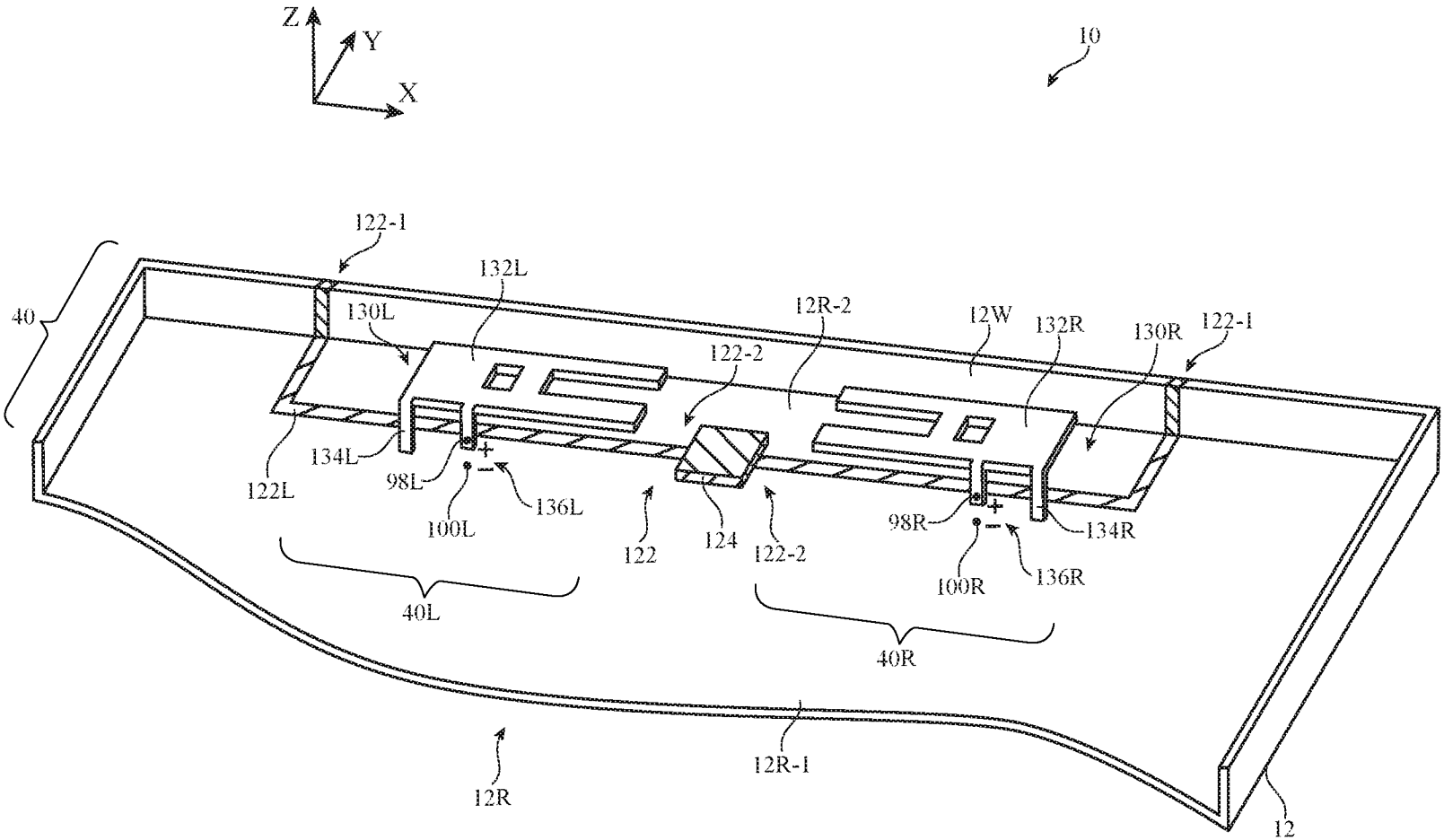
FIG. 6 is a perspective interior view of an illustrative electronic device with a housing slot that has been divided into left and right slots for hybrid planar inverted-F-slot antennas in accordance with an embodiment.

Antennas 40 may include hybrid antennas formed both from inverted-F antenna structures (e.g., planar inverted-F antenna structures) and slot antenna structures. An illustrative configuration in which device 10 has two hybrid antennas formed from the left and right portions of slot 122 in housing 12 is shown in FIG. 6. FIG. 6 is an interior perspective view of device 10 at the upper end of housing 12. As shown in FIG. 6, slot 122 may be divided into left half slot 122L and right half slot 122R by conductive structures 124 that bridge the center of slot 122. Rear housing wall 12R (e.g., a metal housing wall in housing 12) may have a first portion such as portion 12R-1 and a second portion such as portion 12R-2 that is separated from portion 12R-1 by slot 122. Conductive structures 124 may be shorted to rear housing wall portion 12R-1 on one side of slot 122 and may be shorted to rear housing wall portion 12R-2 on the other side of slot 122. The presence of the short circuit formed by structures 124 across slot 122 creates closed ends 122-2 for left slot 122L and right slot 122R.

Antennas 40 of FIG. 6 include left antenna 40L and right antenna 40R. Device 10 may switch between antennas 40L and 40R in real time to ensure that signal strength is maximized, may use antennas 40L and 40R simultaneously, or may otherwise use antennas 40L and 40R to enhance wireless performance for device 10.

Left antenna 40F and right antenna 40R may be hybrid planar-inverted-F-slot antennas each of which has a planar inverted-F antenna resonating element and a slot antenna resonating element.

The slot antenna resonating element of antenna 40L is formed by slot 122L. Planar-inverted-F resonating element 130L serves as an indirect feeding structure for antenna 40L and is near-field coupled to the slot resonating element formed from slot 122L. During operation, slot 122L and element 130L may each contribute to the overall frequency response of antenna 40L. As shown in FIG. 6, antenna 40L may have an antenna feed such as feed 136L. Feed 136L is coupled to planar inverted-F antenna resonating element 130L. A transmission line (see, e.g., transmission line 92 of FIG. 5) may be coupled between transceiver circuitry 90 and antenna feed 136L. Feed 136L has positive antenna feed terminal 98L and ground antenna feed terminal 100L. Ground antenna feed terminal 100L may be shorted to ground (e.g., metal wall 12R-1). Positive antenna feed terminal 98L may be coupled to planar metal element 132L via a leg or other conductive path that extends downwards from planar-inverted-F antenna resonating element 130L towards the ground formed from metal wall 12R-1. Planar-inverted-F antenna resonating element 130L may also have a return path such as return path 134L that is coupled between planar element 132L and antenna ground (metal housing 12R-1) in parallel with feed 136L.

The slot antenna resonating element of antenna 40R is formed by slot 122R. Planar-inverted-F resonating element 130R serves as an indirect feeding structure for antenna 40R and is near-field coupled to the slot resonating element formed from slot 122R. Slot 122R and element 130R may both contribute to the overall frequency response of hybrid planar-inverted-F-slot antenna 40R. Antenna 40R may have an antenna feed such as feed 136R. Feed 136R is coupled to planar inverted-F antenna resonating element 130R. A transmission line such as transmission line 92 may be coupled between transceiver circuitry 90 and antenna feed 136R. Feed 136R may have positive antenna feed terminal 98R and ground antenna feed terminal 100R. Ground antenna feed terminal 100R may be shorted to ground (e.g., metal wall 12R-1). Positive antenna feed terminal 98R may be coupled to planar metal element 132R of planar-inverted-F antenna resonating element 130R. Planar-inverted-F antenna resonating element 130R may also have a return path such as return path 134R that is coupled between planar element 132R and antenna ground (metal housing 12R-1).

Slots 122L and 122R may have lengths (quarter wavelength lengths) that support a native resonance at about 1.1 GHz or other suitable frequency. The presence of planar-inverted-F elements 130L and 130R and other components (e.g., tuning components) may lower the frequency of the slot resonance to cover a low communications band (e.g., a low band at frequencies between 700 and 960 MHz). Mid-band coverage (e.g., for a mid-band centered at 1700 MHz) may be provided by the resonance exhibited by planar inverted-F antenna resonating elements 130L and 130R. High band coverage (e.g., for a high band centered at 2400

MHz) may be supported using harmonics of the slot antenna resonating element resonance (e.g., a third order harmonic, etc.).

Once way to lower the slot resonance to cover desired low band frequencies involves incorporating inductive components into antennas 40L and 40R (e.g., fixed and/or tunable components such as tunable components 102 of FIG. 5). As shown in the left antenna example of FIG. 7, a tunable inductor such as inductor 140L for antenna 40L may have a first terminal such as terminal 142L that is coupled to portion 12R-2 of metal housing wall (ground) 12R on one side of slot 122L and may have a second terminal such as terminal 144L that is coupled to portion 12R-1 of housing (ground) 12R on the opposing side of slot 122L. There may be two or more inductors such as tunable inductor 140L that bridge each slot. The example of FIG. 7 in which a single inductor 140L bridges slot 122L at a location between planar inverted-F antenna resonating element 130L and closed slot end 122-2 of left slot 122L is merely illustrative.

Figure 8:
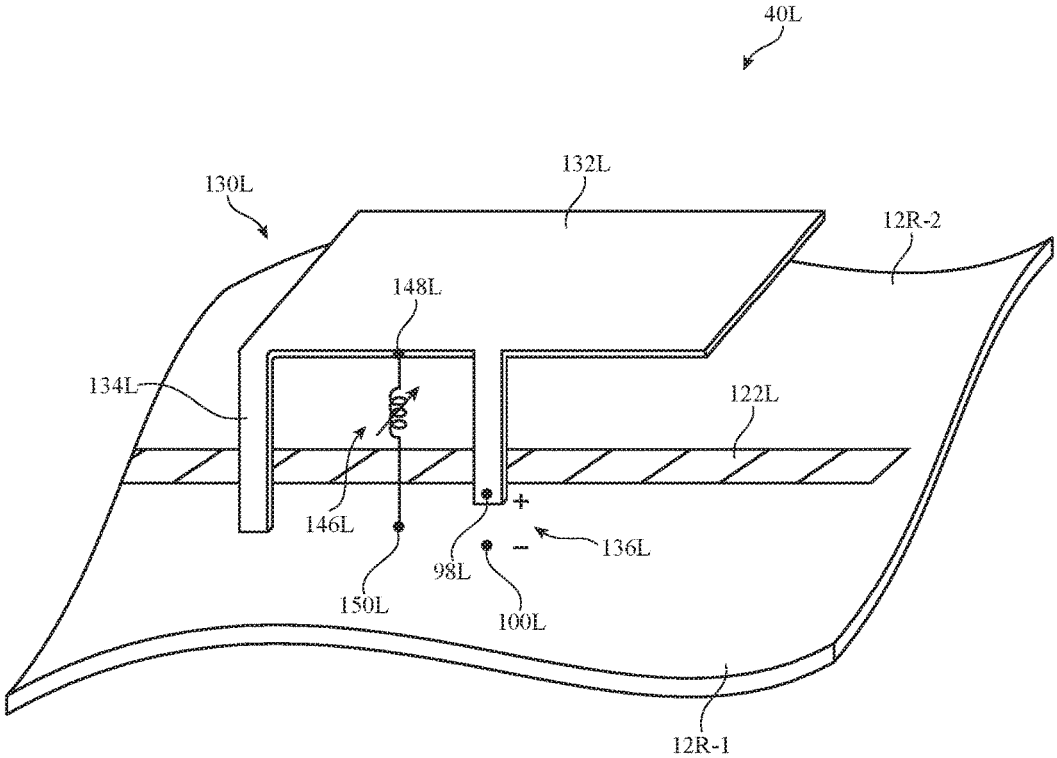
FIG. 8 is a perspective view of a planar inverted-F antenna resonating element and a portion of an associated slot in a hybrid antenna showing how the antenna may be tuned using a tunable inductor that is coupled between the planar inverted-F antenna resonating element and ground in accordance with an embodiment.

Another potential tuning arrangement for antennas 40L and 40R is shown in FIG. 8. In the example of FIG. 8 (which shows an illustrative tuning arrangement for left antenna 40L), tunable inductor 146L has been coupled between terminal 148L on planar element 132L of planar inverted-F antenna resonating element 130L and terminal 150L at the antenna ground (metal housing portion 12R-1). In this arrangement, tunable inductor 146L is coupled between planar structure 132L and ground in parallel with feed 136L and return path 134L.

Figure 9:
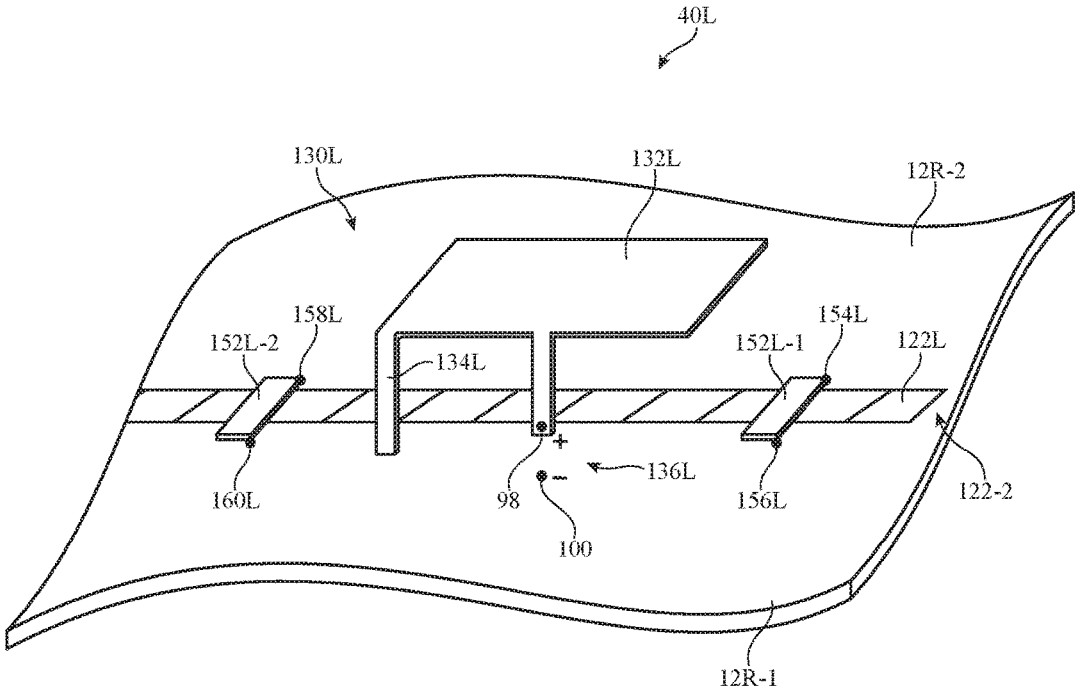
FIG. 9 is a perspective view of an illustrative planar inverted-F antenna resonating element and a portion of an associated slot in a hybrid antenna showing how the antenna may be tuned using a pair of tunable inductors that bridge the slot on opposing sides of the planar inverted-F antenna resonating element in accordance with an embodiment.

As shown in the illustrative configuration of FIG. 9, a pair of tunable inductors may be used to bridge slot 122L at two different locations. Tunable inductor 152L-1 is coupled between terminal 154L on one side of slot 122L and terminal 156L on an opposing side of slot 122L. Terminals 154L and 156L are coupled to the antenna ground formed by metal housing wall portions 12R-2 and 12R-1, respectively. Tunable inductor 152L-2 is coupled between terminal 158L on metal housing wall portion 12R-2 and terminal 160L on metal housing wall portion 12R-1. With this configuration, inductor 152L-1 bridges slot 122L at a location between closed slot end 122-2 and planar inverted-F antenna resonating element 130L and inductor 152L-2 bridges slot 122L at a location between planar inverted-F antenna resonating element 130L and open end 122-1 of slot 122L. If desired, both of inductors 152L-1 and 152L-2 may be located on the same side of planar inverted-F antenna resonating element 130L. Moreover, configurations of the types shown in FIGS. 7, 8, and 9 and other configurations for incorporating tunable inductors and other tunable components 102 into antenna 40L (and 40R) may be used in combination with each other.

The number of tuning states for the inductor circuitry of antennas 40L and 40R may be selected based on the bandwidth of the slot 122 and the frequency range to be covered. Low band tuning with tunable inductors preferably does not significantly impact mid-band and high band coverage, so tunable inductors can be adjusted to ensure that the slot resonance from the slot-antenna resonating element structures covers the low band without disrupting mid-band and high band operation. Two or more tuning states, three or more tuning states, or four or more different tuning states may be used to cover the low band with the slot resonances of the antennas.

Figure 7:
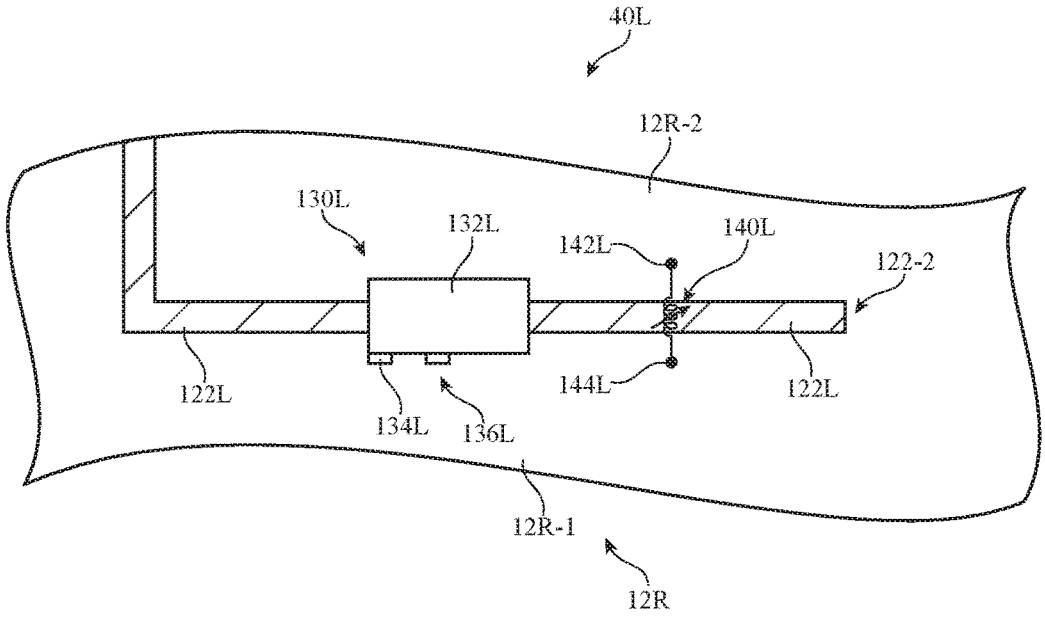
FIG. 7 is a top view of an illustrative hybrid antenna showing how the antenna may be tuned using a tunable inductor that bridges a slot resonating element in accordance with an embodiment.
Figure 10:
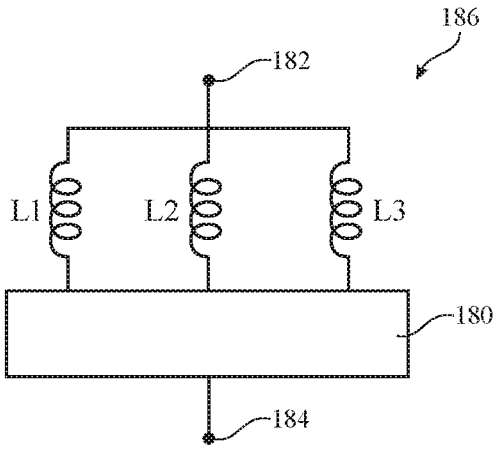
FIG. 10 is a schematic diagram of an illustrative tunable inductor based on a switch and three inductors in accordance with an embodiment.

Consider, as an example, a tuning arrangement of the type shown in FIG. 7 or FIG. 8. With these arrangements, tunable inductor 146L (FIG. 8) or tunable inductor 140L (FIG. 7) may be implemented using a tunable inductor circuit of the type shown by tunable inductor 186 in FIG. 10. As shown in FIG. 10, tunable inductor 186 may have three discrete inductors L1, L2, and L3 and a switch such as switch 180 that switches a desired discrete inductor into use between terminals 182 and 184. Tunable inductor 186 can be adjusted to switch inductor L1 (e.g., a 1 nH inductor), L2 (e.g. a 5 nH inductor), or L3 (e.g., a 30 nH inductor) into use (as an example), so tunable inductor 186 can create three different tuning states for an antenna. If desired, one of the tuning states of inductor 186 may be achieved by disconnecting all inductors to produce "infinite" impedance (infinite inductance). Configurations of the type shown in FIG. 10 may also be used to form desired inductances using combinations of parallel inductors and/or may be used with fewer inductors or more inductors. The arrangement of FIG. 10 is merely illustrative.

Figure 11:
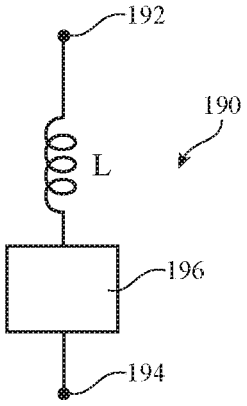
FIG. 11 is a schematic diagram of an illustrative tunable inductor based on an inductor and a switch that switches the inductor into use or out of use in accordance with an embodiment.

As another example, consider tunable inductor 190 of FIG. 11. With this arrangement, tunable inductor 190 has discrete inductor L and switch 196 coupled in series between terminals 192 and 194. Tunable inductors such as tunable inductor 190 may be used to implement inductors 152L-1 and 152L-2 of FIG. 9 (as an example).

Discrete inductors for tunable inductor components can be incorporated into the same package or die as switching circuitry or may be mounted as separate parts on a shared printed circuit (as examples).

Figure 12:
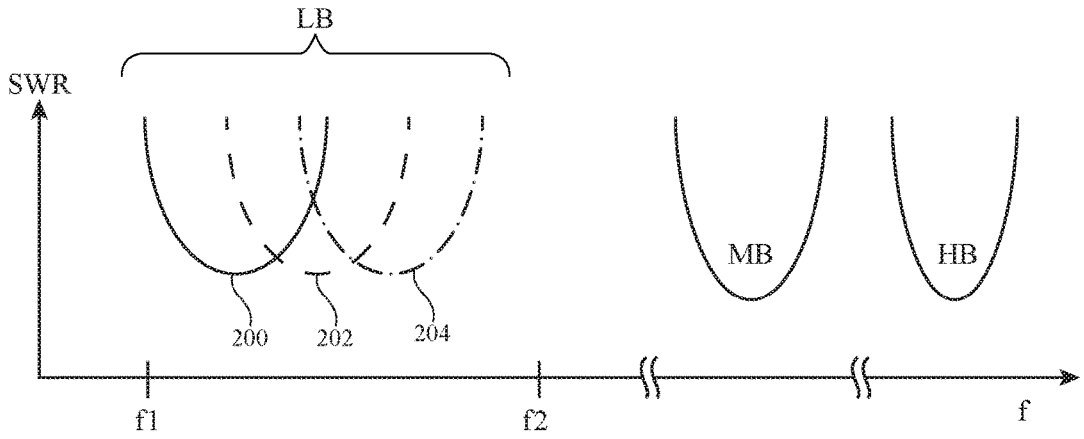
FIG. 12 is a graph in which antenna performance (standing-wave ratio SWR) has been plotted as a function of operating frequency showing how antenna tuning operations may be used to cover desired communications frequencies in accordance with an embodiment.

Antenna tuning results of the type that may be achieved using tunable inductors such as inductors 186 and 190 are shown in FIG. 12. In the graph of FIG. 12, antenna performance (standing wave ratio SWR) has been plotted as a function of operating frequency f for a low band LB, a mid-band MB, and a high band HB. Low band LB may be covered by adjusting an antenna (e.g., left antenna 40L or right antenna 40R) to cover resonances 200, 202, and 204.

Using a tunable antenna such as the antenna of FIG. 7 or the antenna of FIG. 8, a three-state tunable inductor such as inductor 186 of FIG. 10 may be placed in a first state (e.g., an inductance of 30 nH or other suitable inductance) to tune the antenna so that the antenna exhibits low band resonance 200 (e.g., to cover band B17), may be placed in a second state (e.g., an inductance of 5 nH or other suitable inductance) to tune the antenna so that the antenna exhibits low band resonance 202 (e.g., to cover band B20), and may be placed in a third state (e.g., an inductance of 1 nH or other suitable inductance) to tune the antenna so that the antenna exhibits low band resonance 204 (e.g., to cover band B8). Switch 180 may be a single-pole triple-throw switch or other suitable switch in this type of scenario.

Using a tunable antenna such as the antenna of FIG. 9 with tunable (switchable) inductors 190 of FIG. 11 for inductors 152L-1 and 152L-2, resonance 204 may be achieved by opening the switches in both tunable inductor 152L-1 and tunable inductor 152L-2. Resonance 202 (to cover band B20) may be achieved by closing inductor 152L-1 so that its inductance bridges slot 122 and by simultaneously opening inductor 152L-2 (i.e., by opening switch 196 in this inductor) to create an open circuit for inductor 152L-2. Resonance 202 (band B8) may be achieved by closing the switch in inductor 152L-2 and opening the switch in inductors 152L-1. The switches 196 in the tunable inductors 152L-1 and 152L-2 may be single-pole single-throw switches (as an example).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having a metal housing wall that forms a ground plane;

a slot in the metal housing wall that forms a slot antenna resonating element for a hybrid antenna;

a planar inverted-F antenna resonating element for the hybrid antenna that indirectly feeds antenna signals for the slot antenna resonating element via near-field electromagnetic coupling; and first and second tunable components that are configured to tune the hybrid antenna, wherein the planar inverted-F antenna resonating element overlaps the slot across an area, the first and second tunable components extend across the slot at first and second respective locations, and the area is interposed between the first and second locations.

2. The electronic device defined in claim 1 wherein the planar inverted-F antenna resonating element has a planar metal element, a return path coupled between the planar metal element and the ground plane, and an antenna feed having a positive antenna feed terminal and a ground antenna feed terminal coupled between the planar metal element and the ground plane in parallel with the return path.

3. The electronic device defined in claim 2 wherein the slot divides the ground plane into first and second ground plane portions on opposing sides of the slot and wherein the return path and the ground antenna feed terminal are both coupled to the first ground plane portion.

4. The electronic device defined in claim 3 wherein the first tunable component includes a tunable inductor.

5. The electronic device defined in claim 4 wherein the tunable inductor bridges the slot and is coupled between the first and second ground plane portions.

6. The electronic device defined in claim 5 wherein the second tunable component comprises an additional tunable inductor that bridges the slot and is coupled between the first and second ground plane portions.

7. The electronic device defined in claim 6 wherein the slot has an open end and a closed end and wherein the tunable inductor bridges the slot at a location between the planar inverted-F antenna resonating element and the closed end.

8. The electronic device defined in claim 7 wherein the additional tunable inductor bridges the slot at a location between the planar inverted-F antenna resonating element and the open end.

9. The electronic device defined in claim 8 wherein the tunable inductor and the additional tunable inductor are switchable between open and closed states to tune the hybrid antenna to at least three different low band resonances.

10. The electronic device defined in claim 1, wherein the first tunable component has first and second terminals respectively coupled to first and second opposing sides of the slot.

11. The electronic device defined in claim 1, wherein the slot divides the ground plane into first and second ground plane portions on opposing sides of the slot, and a conductive member that bisects the slot and that shorts the first ground plane portion to the second ground plane portion.

12. An electronic device, comprising:

a metal housing with four edges;

first and second antennas located along one of the four edges, wherein each of the first and second antennas is a hybrid antenna that includes:

a ground plane formed from a portion of the metal housing;

a slot in the ground plane that forms a slot antenna resonating element for the hybrid antenna, wherein a conductive structure separates the slot of the first antenna from the slot of the second antenna;

a planar inverted-F antenna resonating element for the hybrid antenna that indirectly feeds the slot antenna resonating element, wherein the conductive structure is interposed between the planar inverted-F antenna resonating element of the first antenna and the planar inverted-F antenna resonating element of the second antenna; and a tunable inductor that tunes the hybrid antenna.

13. The electronic device defined in claim 12 wherein the tunable inductor for the first antenna is coupled between a portion of the planar inverted-F antenna resonating element for the first antenna and the ground plane for the first antenna.

14. The electronic device defined in claim 12 wherein the tunable inductor for the first antenna bridges the slot.

15. The electronic device defined in claim 12 wherein the metal housing has a metal rear housing wall and metal housing sidewalls wherein the ground plane for the first antenna is formed from the metal rear housing wall and metal housing sidewalls.

16. The electronic device in claim 12, wherein the conductive structure comprises a shorting structure having first and second opposing sides, the first side forms a first closed end for the slot of the first antenna, and the second side forms a second closed end for the slot of the second antenna.

17. The electronic device in claim 12, wherein the planar inverted-F antenna resonating element of the first antenna overlaps the slot of the first antenna at a first location, the planar inverted-F antenna resonating element of the second antenna overlaps the slot of the second antenna at a second location and the conductive structure is interposed between the first and second locations.

18. The electronic device in claim 12, wherein the slot for each of the first and second antenna has a closed end defined by the conductive structure and an open end that terminates at the one of the four edges.

19. An antenna, comprising:

a metal electronic device housing wall;

a slot in the metal electronic device housing wall, wherein first and second portions of the metal electronic device housing wall are located on opposing first and second sides of the slot;

a planar inverted-F antenna resonating element that has a planar metal element having an edge on the first side of the slot, a return path coupled between the edge of the planar metal element and the first portion of the metal electronic device housing wall on the first side of the slot, and an antenna feed having a positive antenna feed terminal coupled to the edge of the planar metal element on the first side of the slot and a ground antenna feed terminal coupled to the first portion of the metal electronic device housing wall on the first side of the slot; and a tunable inductor having a first terminal coupled to a location along the edge of the planar metal element between the return path and the positive antenna feed terminal and having a second terminal coupled to the first portion of the metal electronic device housing wall on the first side of the slot between the return path and the ground antenna feed terminal.

20. The antenna defined in claim 19 further comprising a tunable inductor having a terminal coupled to the first portion of the metal electronic device housing wall.

* * * * *